US007311423B2

(12) United States Patent
Frecska et al.

(10) Patent No.: US 7,311,423 B2
(45) Date of Patent: Dec. 25, 2007

(54) ADJUSTABLE LED LUMINAIRE

(75) Inventors: Sandor A. Frecska, Lancaster, PA (US); Jere W. Myers, Washington Boro, PA (US)

(73) Assignee: AWI Licensing Company, Wilmington, DE (US)

( * ) Notice: Subject to any disclaimer, the term of this patent is extended or adjusted under 35 U.S.C. 154(b) by 121 days.

(21) Appl. No.: 11/231,461

(22) Filed: Sep. 21, 2005

(65) Prior Publication Data

US 2007/0064425 A1 Mar. 22, 2007

(51) Int. Cl.
*F21V 33/00* (2006.01)

(52) U.S. Cl. ..... 362/372; 362/20; 362/150; 362/500; 362/545

(58) Field of Classification Search ..... 362/20, 362/150, 500, 545, 649, 372
See application file for complete search history.

(56) References Cited

U.S. PATENT DOCUMENTS

| | | | | |
|---|---|---|---|---|
| 739,845 | A * | 9/1903 | Evans | 40/432 |
| 5,688,042 | A | 11/1997 | Madadi et al. | |
| 5,890,794 | A | 4/1999 | Abtahi et al. | |
| 6,056,420 | A | 5/2000 | Wilson et al. | |
| 6,540,373 | B2 * | 4/2003 | Bailey | 362/150 |
| 6,659,622 | B2 | 12/2003 | Katogi et al. | |
| 6,705,742 | B1 | 3/2004 | Patterson et al. | |
| 6,726,348 | B2 | 4/2004 | Gloisten | |
| 6,762,562 | B2 | 7/2004 | Leong | |
| 6,789,914 | B1 | 9/2004 | Brown et al. | |
| 6,843,586 | B1 | 1/2005 | Allaire | |
| 6,860,628 | B2 | 3/2005 | Robertson et al. | |
| 7,052,171 | B1 * | 5/2006 | Lefebvre et al. | 362/649 |
| 7,118,235 | B2 * | 10/2006 | Barton | 362/20 |
| 7,160,009 | B1 * | 1/2007 | Martin | 362/500 |
| 2002/0060526 | A1 | 5/2002 | Timmermans et al. | |
| 2003/0076281 | A1 | 4/2003 | Morgan et al. | |
| 2004/0189218 | A1 | 9/2004 | Leong et al. | |

OTHER PUBLICATIONS

Lightolier—A Genlyte Thomas Company; Lighting Systems—Agili T—A Whole New Level of Lighting Design Flexibility—Lightolieri; Lightolier—US Catatlog LOL27030; 2001; pp. 1-25; Genlyte Thomas Group, LLC; Fall River, MA; USA.

* cited by examiner

*Primary Examiner*—Sandra O'Shea
*Assistant Examiner*—James W Cranson, Jr.

(57) ABSTRACT

A lighting fixture apparatus includes a frame portion, a louver portion and a diffuser lens. The louver portion includes a baffle system for passing unobstructed at least a portion of the light impinging thereon. The diffuser lens includes a surface for diffusing light rays. At least one directional lighting apparatus comprised of LED strips is attached to and supported by the frame portion. The LED strips are disposed between the louver portion and the diffuser portion. The LED assembly includes a rigid strip having a first end and a second end opposite the first end portion, and a first surface and a second surface opposite the second surface. A first rotary support member and a second rotary support member are connected to the strip portion at respective first and second ends. A plurality of electrical lighting elements are mounted on the first surface and are configured in at least one electrical circuit.

28 Claims, 5 Drawing Sheets

ADJUSTABLE LED LUMINAIRE

FIELD OF THE INVENTION

The present invention is directed to a luminance, and more particularly to a luminance having a light source comprising light-emitting diodes (LEDs).

BACKGROUND OF THE INVENTION

Conventional luminaires used in lighting systems are generally classified as direct or indirect lighting fixtures. Direct lighting shines directly on a surface, such as a desktop or work surface, without being reflected from another surface. Indirect lighting is ambient lighting that is reflected from another surface such as a ceiling before impinging on the lighted area or surface. More recently, hybrid type fixtures have been developed that include both direct and indirect lighting characteristics. Such lights may be specified with the percentage of direct/indirect light characteristics, for example, 65%/35%, where 65% is the portion of indirect and 35% the portion of direct, of the total light emitted by the fixture. These ratios are generally achieved using fluorescent lighting tubes that emit light equally in all directions.

The light distribution ratio between direct and indirect is accomplished through the geometry of the fixture in which the fluorescent tubes are mounted. Diffusers and parabolic reflectors are positioned below the fluorescent tubes to reflect portions of the downwardly directed light, which is then reflected to the ceiling. Ceilings normally have an irregular surface that further diffuses and scatters the light, rather than directly reflecting the light. The percentage of indirect to direct light may be designed with more or less direct light. Once the light distribution profile of a luminance is set in the manufacturing stage it is not capable of being varied without disassembling and rebuilding the entire fixture with different components.

U.S. Pat. No. 6,789,914 discloses a luminance that provides both direct and indirect lighting through elongated reflecting members and a main reflector for delivering a uniform illumination. Each reflecting member is a louver extending along the luminance sides and the main reflector extends between the luminance sides. The luminance reflects light directly and indirectly to furnish a uniform illumination without undesirable hot spots and glare.

U.S. Pat. No. 6,843,586 is directed to a luminance having a concave reflector suspended from the ceiling. The reflector is positioned directly in the path of the light. The light is shielded from the reflector and diffused by being reflected onto the walls and ceiling. A reflector dome may be positioned above the light source and opposite the pendant reflector. The luminance redirects diffused light reflected by the pendant reflector while shielding a viewer from the intense light present at its point source.

U.S. Pat. No. 6,705,742 is directed to a system for directing light from a luminance. The luminance includes a source of light removably positionable in the luminance, a first reflecting device installed in the luminance for transmitting substantially indirect lighting from the luminance, a second reflecting device mounted in the luminance for transmitting substantially direct lighting from the luminance, and a fascia engageable with the luminance for emitting substantially luminous direct lighting. The luminance is useful for providing combinations and permutations of direct and indirect lighting.

Referring first to FIG. 1, an exemplary prior art luminance is generally designated as 10. A single lamp serving as a light source 12 is disposed between a louver portion 14 and a diffuser lens 16. Rays of light 20 are emitted radially from the light source 12 substantially uniformly in every direction. A portion of the light rays 20 emitted from the light source 12 are directed toward the ceiling 26. The upward light rays 20 penetrate the diffuser lens 16 and are spread or scattered by the diffuser lens 16 into a generally random pattern in the direction of the ceiling 26. The scattered light rays 20' are then reflected from the ceiling 26 toward the area below the luminance 10, to provide the indirect component of the light distribution.

A portion of the light rays 20 emitted from the light source 12 are also directed toward the louver portion 14, as indicated by arrows 30 and 30'. The light rays 20 in the downward direction impinge on the louver portion 14 at various angles. The downward light rays 30, 30' thus provide the direct component of the light distribution, and an additional portion of the indirect light distribution. Yet another portion of the light rays 20 are emitted horizontally, and do not impinge on either the diffuser portion 16 or the louver portion 14. This horizontally emitted portion of the light rays 20 accounts for ambient light in the general area.

The luminance shown in FIG. 1 is for illustration only, and many variations of these arrangements are known to those skilled in the art. For example, 2-, 4- or 8-lamp luminaires are commonly available, and the louver portions may be comprised of a variety of plastic lenses, parabolic reflectors, diffusers, and combinations thereof.

LED light sources offer several benefits over fluorescent systems, such as reliability, longer life, reduced heat dissipation, and reduced energy consumption, with little or no added weight. High voltage ballasts that are required to start the fluorescent tubes are not needed for LED light sources.

A light source made from LEDs is highly directional, focusing most light in one orientation as opposed to the continuous radial distribution of light around a fluorescent tube. The combination of mounting, location, filtering and distribution of white LEDs in a multi-LED design is critical to achieving an aesthetic light output. The directional nature of the diodes themselves creates a situation where a slight angular change in the installation can significantly change the appearance of lighted areas. As a result, the primary usage of LED light sources to date has been for commercial signage and architectural accent lighting, rather than general-purpose lighting. LEDs offer many advantages, including low power consumption, low heat dissipation and much longer life compared to traditional fluorescent and incandescent bulbs.

Therefore what is needed is a luminance that can have variable ratios of direct/indirect lighting without the need to change the geometry of the luminance.

SUMMARY OF THE INVENTION

The present invention is directed to a rotatable directional lighting apparatus comprising a rigid strip having a first end and a second end opposite said first end portion. The rigid strip also has a first surface and a second surface opposite said first surface, the first and second surfaces extending between the first and second end. A first rotary support member and a second rotary support member are connected to the strip first and second ends, respectively. A plurality of electrical lighting elements is mounted on the first surface. The lighting elements are configured in at least one electrical circuit. The electrical lighting elements are preferably light emitting diodes (LEDs). Also, the first rotary support member includes an electrical actuator for automatically positioning the angle of rotation of the rigid strip.

In another aspect of the invention, there is a lighting fixture apparatus comprising a frame portion, a louver portion and a diffuser lens. The louver portion includes a baffle system for passing unobstructed at least a portion of light rays impinging thereon as direct lighting. The diffuser lens includes a surface for diffusing light rays impinging thereupon as indirect lighting. At least one directional lighting apparatus is attached to and supported by the frame portion, with the directional lighting apparatus being disposed between the louver portion and the diffuser portion.

The uni-directional lighting apparatus comprises a rigid strip having a first end and a second end opposite said first end. The rigid strip also has a first surface and a second surface opposite said second surface. A first rotary support member and a second rotary support member are connected to the strip portion first and second ends, respectively. A plurality of electrical lighting elements is mounted on the first surface. The lighting elements are configured in at least one electrical circuit. The electrical lighting elements are preferably light emitting diodes (LEDs). Also, the first rotary support member includes an electrical actuator for positioning the angle of rotation of the rigid strip.

One advantage of the present invention is the ability to vary the ratio of direct to indirect light emitted by a luminance.

Another advantage is the ability to change the ratio of direct to indirect light emitted by a luminance by rotating the light source, without the need to modify the geometry of the luminance.

Another advantage is the ability to provide a luminance with standard or non-standard ratio of direct to indirect light distribution.

A further advantage of the present invention is the elimination of high voltage ballasts.

Yet another advantage of the present invention is the ability to remotely control the ration of direct to indirect light emitted from luminaries after installation of the fixture in a ceiling or grid pattern.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
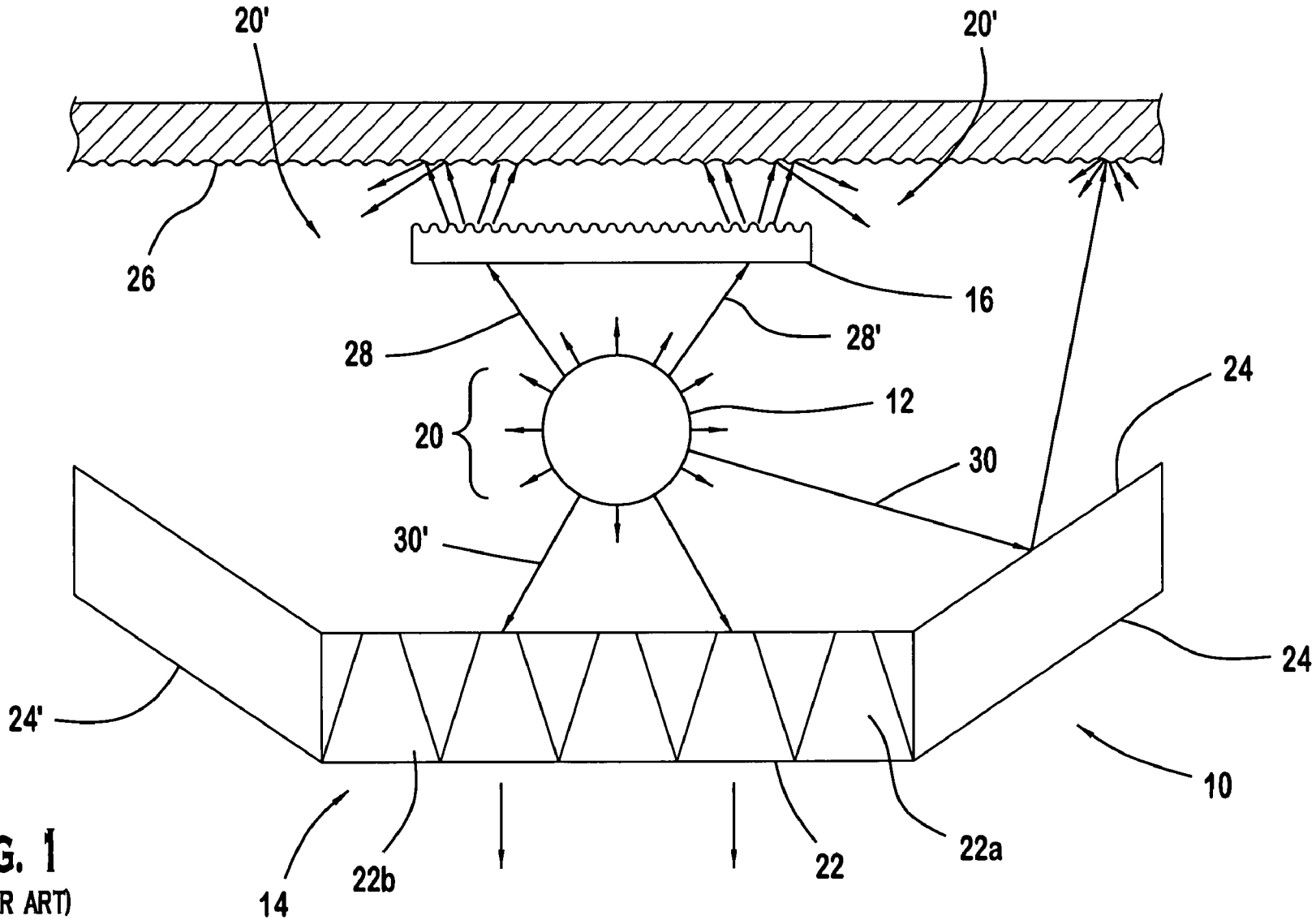
FIG. 1 (PRIOR ART)
FIG. 1 is a cross-sectional view of a prior art luminance.
Figure 2:
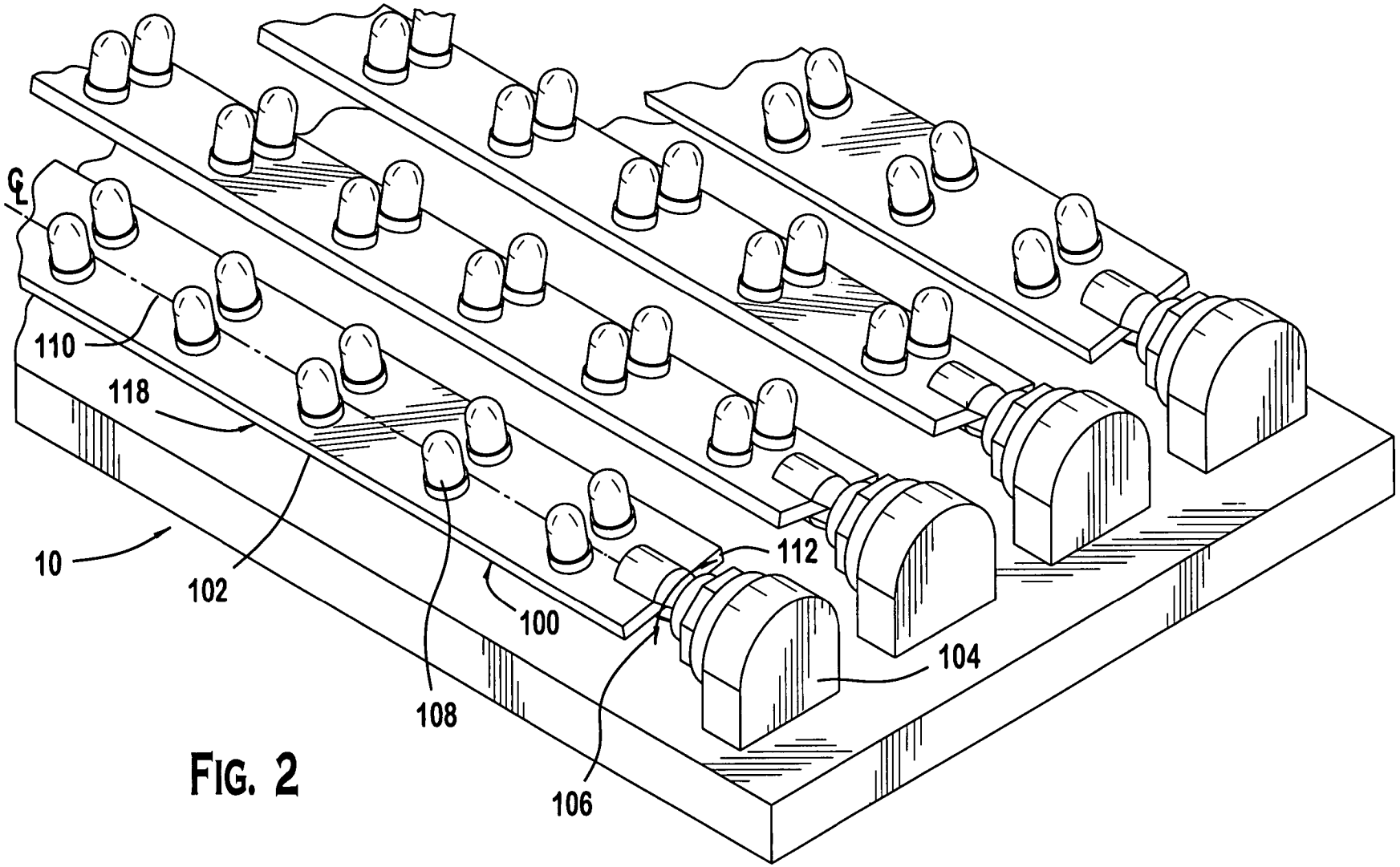
FIG. 2 is a fragmentary perspective view of the LED lamp assemblies in a luminance.
Figure 3A:
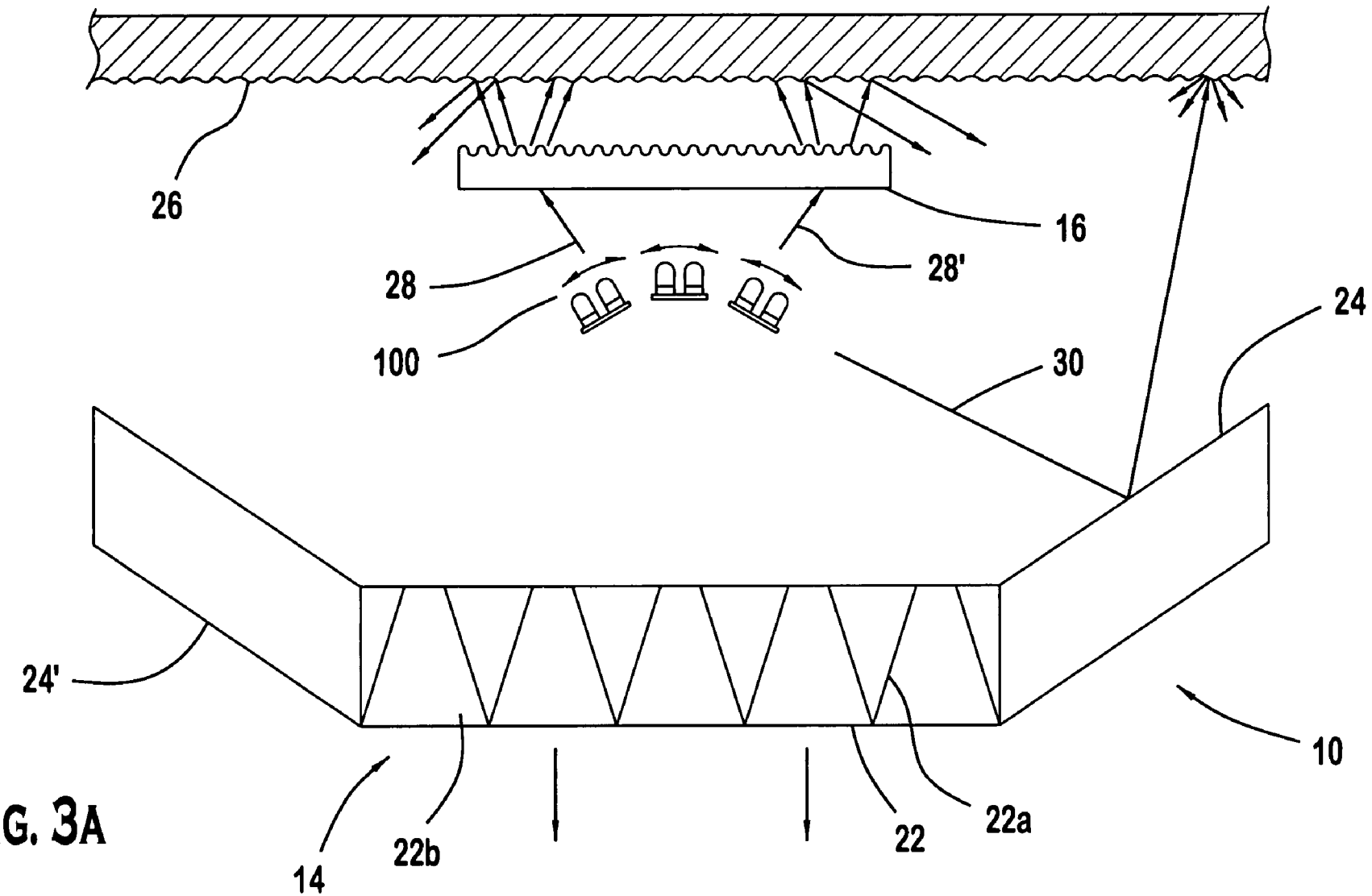
FIGS. 3A and 3B are cross-sectional views of two embodiments of the present invention.
Figure 3B:
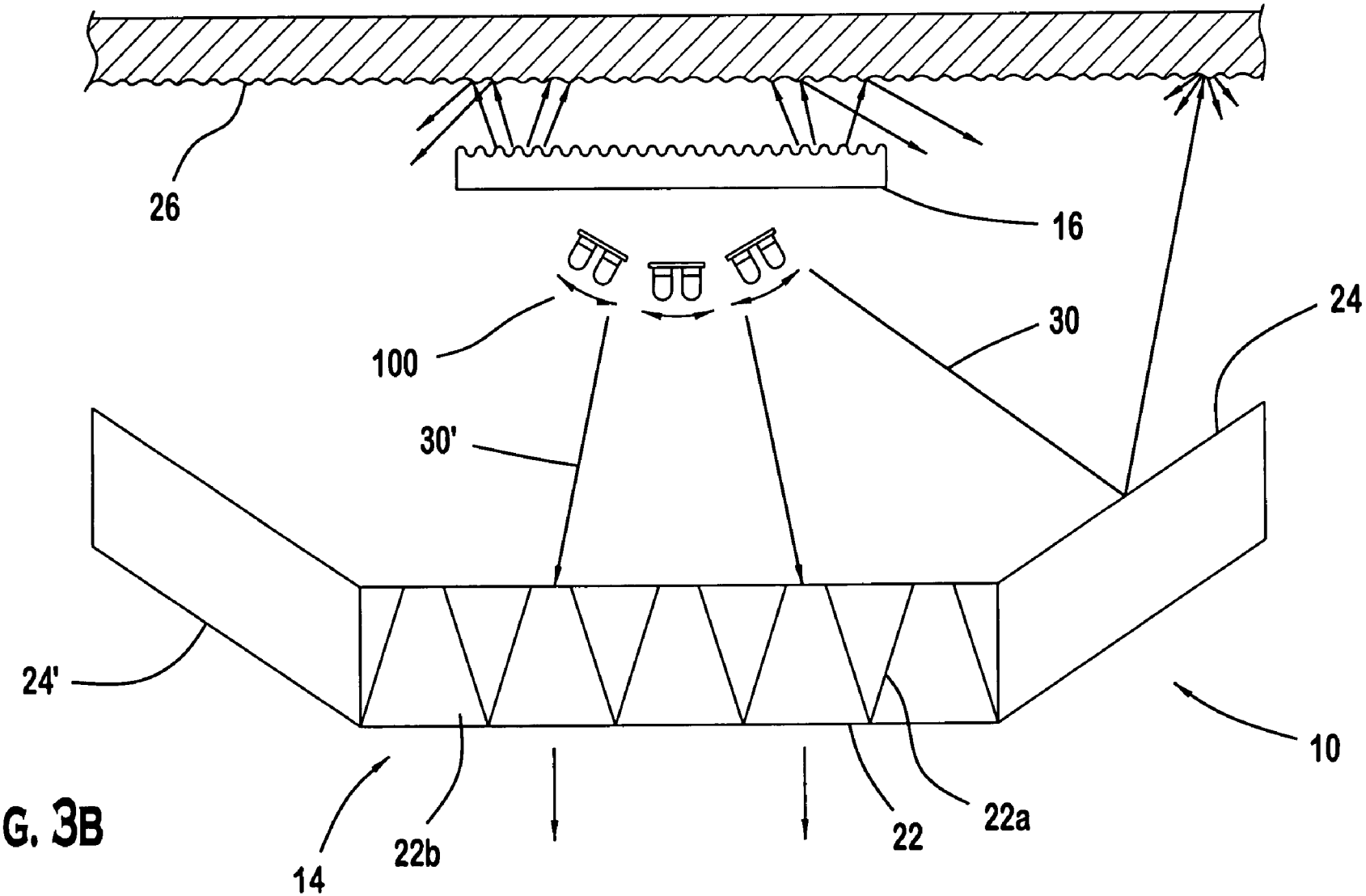

Referring to FIGS. 2, 3A and 3B, a luminance is generally designated as 10. A plurality of LED assemblies 100 are disposed between a louver portion 14 and a diffuser lens 16. Rays of light 20 are emitted radially from LED's 108 in a predetermined cone arrangement. FIGS. 3A and 3B are similar to FIG. 1, except that the tubular source, such as a prior art fluorescent tube emitting light uniformly in all directions is replaced by LED assemblies, which are somewhat directional. Louver portion 14 includes a baffle portion 22 and reflector plates 24, 24' arranged at opposite sides of the baffle portion 22, preferably angled upward toward the ceiling to partially shroud the light source 12 from direct view. Baffle portion 22 typically includes a plurality of baffle segments 22*a* and openings 22*b*. Baffle segments 22*a* are arranged in a grid or in parallel relation with each other, for reflecting and redirecting the impinging light rays 20. Openings 22*b* are defined by the baffle segments 22*a* for passing the light rays 20 through to the area below. Baffle segments 22*a* are preferably coated with a specular, white or semi-specular surface coating.

The LED assembly may be fixed, however additional advantages are achieved when its position can be adjusted. A portion of the LED assemblies 100 is directed toward the ceiling 26 as indicated by arrows 28 and 28'. The upward light rays 20 penetrate the diffuser lens 16 and are spread or scattered by the diffuser lens 16 into a generally random pattern in the direction of the ceiling 26. The scattered light rays 20' are then reflected from the ceiling 26 toward the area below the luminance 10, to provide the indirect component of the light distribution.

A portion of the LED assemblies 100 are also directed toward the louver portion 14, as indicated by arrows 30 and 30'. The LED assemblies 100 in the downward direction impinge on the louver portion 14 at various angles, with a portion of the rays passing unobstructed through the louver portion 14 as direct lighting and a portion of the rays being reflected, diffused or refracted by the louver portion 14 as indirect lighting, depending on the arrangement of the baffle portion 22. The downward light rays 30, 30' thus provide the direct component of the light distribution, and an additional portion of the indirect light distribution of the luminance 10. Yet another portion of the LED assemblies 100 can be directed intermediately of the vertical plane, and impinge on reflector plates 24, 24' connected to louver portion 14. This horizontally emitted portion of the light rays 20 accounts for ambient light in the general area. The portion of LED assemblies 100 directed toward the ceiling 26, toward the louver 14 or toward the reflector plates 24, 24' can be varied as desired.

The LED assemblies 100 may be used in practically any configuration of luminance that uses fluorescent tubes, for suspension or mounting below a reflective ceiling and the invention is not limited to the configuration shown in the drawings, as will be readily apparent to those skilled in the art.

Referring next to FIG. 2, LED assemblies 100 comprise elongated strips 102 with an array of LEDs 108 arranged on one side of a strip 102. The strip 102 is comprised of a rigid material capable of supporting the weight of the LEDs 108 mounted thereon, over a span of two to eight feet without significant sagging or bending. Preferably, the strip 102 is comprised of an opaque material. If it desired to have some light infiltration through the blank side of the strip 118, a translucent or transparent material may optionally be employed.

The LEDs 108 may be arranged in one or more rows, e.g., rows of two as shown in FIGS. 2, 3A and 3B, to provide in its simplest form the ability to control the intensity of the light emitted from each row. Strips 102 are attached at both ends to rotating assemblies 104. Rotating assemblies 104 support the strip 102 in the luminance 100 frame, and rotate the LED assemblies 100 through a predetermined angle (indicated by arrow 106) about a first axis 110 extending from a first end 112 to a second end (not shown) such that each strip 102 is reversible with respect to the direction of the LEDs 108. Preferably, the angular adjustment can subtend angles from 0° (directly downward) to 180° (directly upward).

The LED assemblies 100 are mounted in the luminance 10 instead of standard fluorescent tubes. One of the rotating assemblies 104 attached to the strip includes an electrical actuator (not shown). Preferably, each electrical actuator is a low voltage DC type actuator. The end of the LED assembly 100 opposite the electrically actuated rotating assembly 104 is supported in a non-actuated rotating assembly 104 that allows the respective LED assembly to rotate about a longitudinal axis in response to the position of the actuated assembly 104. The electrical actuator for the rotating assembly 104 is connected to a controller (not shown) that may be provided on each luminance 10; alternately, the actuator may be connected to a central controller located remote from the luminance 10. Remote control of the actuators may also be performed using infrared (IR) or radio frequency (RF) type controls.

Each LED assembly 100 turns independently of the other LED assembly or assemblies 100 mounted in the luminance 10, such that the LED assemblies 100 may be positioned at various angles relative to each other—e.g., two strips facing up and two stips facing down—to provide varying patterns of direct and indirect lighting. In an alternate embodiment (not shown), a single drive motor may be synchronously interconnected through a gear arrangement to rotating assemblies 104 such that some or all of the assemblies are driven simultaneously rather than independently.

It will be understood that in its simplest embodiment each LED assembly is controlled by a mechanical actuator that can control the ratio of direct/indirect lighting of the luminance, and LEDs on the assembly connected in a single circuit. It will be further understood that any one row having a plurality of LEDs may have a plurality of individual circuit connections (not shown), and a row of LEDs can be wired such that a plurality of electrical circuits can control one or more LEDs in the row. By selectively switching LED circuits in this manner, the intensity of light from LEDs in any one row may be varied if desired.

Each rotating assembly 104 is retentively positionable through at least one actuator 104. The rotating assembly 104 can be set at any angle from 0° to 360°, but preferably 0° to 180°, to provide a continuously variable ratio of direct and indirect lighting. If an LED assembly 100 is set at an angle between the horizontal plane and the vertical plane, the rotating assembly maintains the setting until the angle is readjusted.

Referring next to FIGS. 3A and 3B, a plurality of LED assemblies 100 are mounted in a conventional luminance 10. Three LED assemblies 100 are mounted across the interior, between the louver portion 14 and the diffuser lens 16. LEDs 108 preferably emit light directionally, in a predetermined cone-shaped spread of, for example, 30°, making it possible to direct the light more selectively than other sources such as fluorescent tubes or incandescent light bulbs. By selectively positioning each LED assembly 100 at a desired angle, a substantially infinite combination of ratios of direct/indirect light distribution may be achieved, ranging from 0% /100%—i.e., all LED assemblies are rotated to face the ceiling - to 100% /0%—i.e., all LEDs rotated to face the floor. The intensity of each row of LEDs 108 may optionally be controlled by varying the voltage applied across each row of LEDs 108 or by varying the voltage to LEDs within a row, when the rows are appropriately wired in series, as discussed above. Thus, the luminance distribution of the fixture can be varied in the range from one of soft indirect lighting to one of direct task lighting.

Preferably, the LED assemblies 100 are wired to receive a DC voltage—e.g., 6V, 12V, 18V or 24V—from a ceiling grid with a power supply and wiring connected thereto. One such ceiling grid arrangement is described in detail in U.S. patent application Ser. No. 11/127,853, assigned to Armstrong World Industries, Inc., of Lancaster, Pa, which patent application is hereby incorporated by reference. Alternately, the LED assemblies may be connected to accommodate voltages that are standard in commercial, residential and industrial lighting distribution systems—e.g., 110V, 240V, 460V—to permit them to easily be retrofitted in place of traditional fluorescent and incandescent luminaires.

Figure 4:
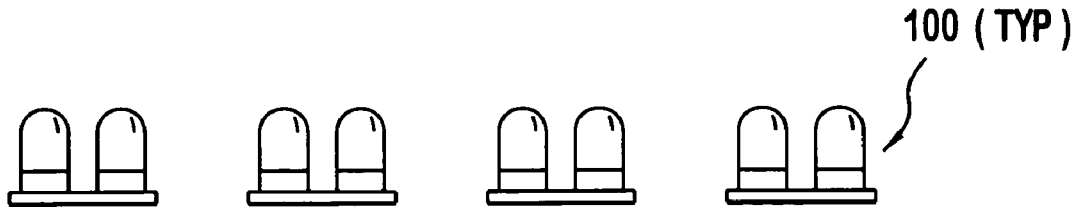
FIGS. 4 through 7 illustrate various arrangements of LED lamp assemblies.
Figure 5:
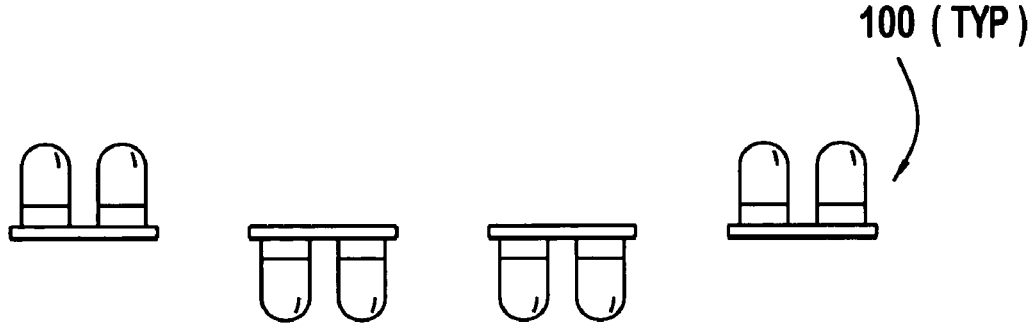
Figure 6:
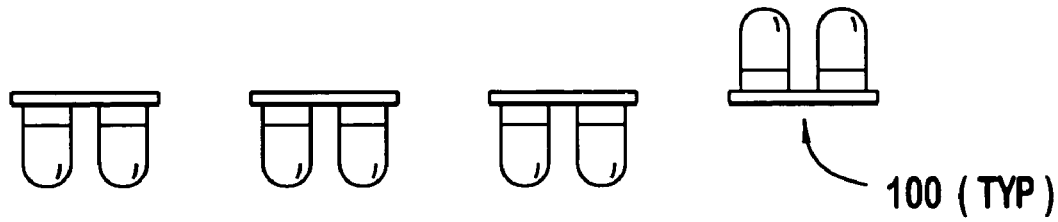
Figure 7:
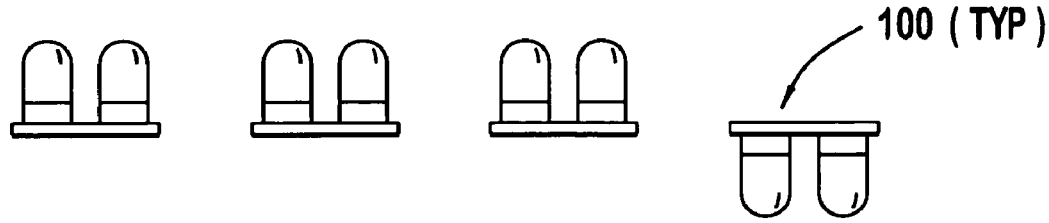

FIGS. 4 through 7 show LED assemblies 100 rotated in various configurations, as examples for varying the direct/indirect lighting ratio. In FIG. 4, four assemblies 100 are positioned in a horizontal row in, with all of the LEDs facing the ceiling. The direct/indirect ration is approximately 0% /100%. FIG. 5 shows the two center LED assemblies 100 facing down, or rotated 180° from the center LED assemblies 100 in FIG. 4, and the two outer LED assemblies 100 facing the ceiling. The direct/indirect ratio is approximately 50% /50%. FIG. 6 shows three LED assemblies 100 facing up, and one LED assembly pointing down, for a direct/indirect ratio of approximately 75% /25%. and in FIG. 7 the LED assemblies 100 are arranged inversely of the arrangement in FIG. 6, with three LED assemblies 100 facing down, and one LED assembly pointing up, for a direct/indirect ratio of approximately 25% /75%.

Other configurations of luminaires may include a mixture of rotating LED assemblies 100 and fixed, or non-rotating, LED assemblies 100, for example, where a certain minimum level of direct lighting is desired, or a minimum level of indirect lighting is desired. In such a case, one or more non-rotating LED 100 assemblies may be arranged to face downward to the lighted workspace in the case of a minimum fixed direct lighting level, or upward to the ceiling in the case of minimum fixed indirect lighting. The luminance 10 would include one or more rotating LED assemblies 100 to increase the direct or indirect lighting above the minimum fixed level.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A lighting apparatus comprising:

two or more rigid strips, each rigid strip having a first end and a second end opposite said first end and an axis extending from the first end to the second end, and having a first surface and a second surface opposite said first surface; the first surface and second surfaces extending from the first end to the second end; and a plurality of electrical lighting elements mounted on the first surface of each rigid strip;

wherein at least one of the two or more rigid strips is capable of rotational movement about the axis extending from the first end to the second end and wherein the rotational movement of the rigid strip is independent of the other of the two or more rigid strips.

2. The apparatus as set forth in claim 1 wherein the electrical lighting elements are light emitting diodes (LEDs).

3. The apparatus as set forth in claim 2, wherein the LEDs are arranged in a single row.

4. The apparatus as set forth in claim 2, wherein the LEDs are arranged in a plurality of rows.

5. The apparatus as set forth in claim 2, wherein the LEDs are arranged in an array.

6. The apparatus as set forth in claim 1, wherein the rigid strip is selected from one of the group consisting of: (i) opaque material; (ii) translucent material and (iii) transparent material.

7. The apparatus as set forth in claim 1, wherein the plurality of electrical lighting elements are configured to operate at a nominal distribution voltage selected from the group consisting of: 110 V, 220V, 240V, 277V, 460V, 480V, 575V and 600V.

8. The apparatus as set forth in claim 1, wherein the lighting elements are configured in a plurality of electrical circuits, the electrical circuits having switching mean for selectively operating less than all of the lighting elements simultaneously.

9. The apparatus as set forth in claim 8, wherein at least one of the electrical circuits contains dimming means for varying the voltage applied to the lighting elements interconnected with the at least one electrical circuit.

10. The apparatus as set forth in claim 1, further comprising a rotary support member connected to an end of each rigid strip, the rotary support member providing rotational movement of the rigid strip about the axis extending from the first end to the second end of the rigid strip.

11. The apparatus as set forth in claim 10, wherein the rotary support member includes an electrical actuator for automatically positioning an angle of rotation of the rigid strip.

12. The apparatus as set forth in claim 10, including a second rotary support member connected to the strip at the end opposite from the end connected to the first rotary support member.

13. The apparatus as set forth in claim 12, wherein at least one of the first and second rotary support members includes an electrically actuated servomotor.

14. The apparatus as set forth in claim 1, wherein the ratios of direct to indirect lighting can be varied.

15. The apparatus as set forth in claim 14, wherein the ratios of direct to indirect lighting are remotely controlled.

16. The apparatus as set forth in claim 1, wherein the two or more rigid strips are aligned in a single plane.

17. A lighting fixture apparatus comprising:

a frame portion, a louver portion detachably connected to the frame portion, the louver portion including a baffle system for passing unobstructed at least a portion of light impinging thereon; and at least one directional lighting apparatus attached to and supported by the frame portion, the directional lighting apparatus being disposed above the louver portion, the at least one directional lighting apparatus comprising:

a rigid strip having a first end and a second end opposite said first end and an axis extending from the first end to the second end, and having a first surface and a second surface opposite said first surface; first surface and second surface extending from the first end to the second end;

a rotary support member connected to an end of the strip portion, the rotary support member providing rotational movement of the strip about the first axis; and a plurality of electrical lighting elements mounted on the first surface configured in at least one electrical circuit.

18. The apparatus as set forth in claim 17, wherein the electrical lighting elements are light emitting diodes (LEDs).

19. The apparatus as set forth in claim 18, wherein the rigid strip is selected from one of the group consisting of: (i) opaque material; (ii) translucent material and (iii) transparent material.

20. The apparatus as set forth in claim 18, wherein the rotary support member includes an electrical actuator for automatically positioning the angle of rotation of the rigid strip.

21. The apparatus as set forth in claim 20, wherein the LEDs are arranged in a single row.

22. The apparatus as set forth in claim 20, wherein the LEDs are arranged in a plurality of rows.

23. The apparatus as set forth in claim 20, wherein the LEDs are arranged in an array.

24. The apparatus as set forth in claim 17, wherein the directional lighting apparatus is configured to operate at a nominal distribution voltage selected from the group consisting of: 110 V, 220V, 240V, 277V, 460V, 480V, 575V and 600V.

25. The apparatus as set forth in claim 17, wherein the at least one lighting element is operable to vary the percentage of a direct lighting component a total direct/indirect lighting output of the lighting fixture between approximately 0% to approximately 100% of the total direct/indirect lighting output of the lighting fixture.

26. The apparatus as set forth in claim 17, wherein the lighting fixture includes a plurality of lighting elements, and at least one lighting element is fixed in a non-rotatable position, and at least one other lighting element operable to vary the percentage of a direct lighting component of the lighting fixture.

27. The apparatus as set forth in claim 26, wherein the louver portion includes at least one reflecting surface for reflecting toward the ceiling at least a portion of light impinging on the louver portion.

28. The apparatus as set forth in claim 17, further including a diffuser lens, having a surface for diffusing light rays impinging thereupon; and the directional lighting apparatus being disposed between the louver portion and the diffuser portion.

* * * * *